US005487210A

United States Patent [19]

Silagy

[11] Patent Number: 5,487,210

[45] Date of Patent: Jan. 30, 1996

[54] BUCKLE FACEPLATE BELT CLAMP

[76] Inventor: Howard Silagy, 100A Tec St., Hicksville, N.Y. 11801

[21] Appl. No.: 322,286

[22] Filed: Oct. 13, 1994

[51] Int. Cl.[6] ..... A44B 11/00

[52] U.S. Cl. ..... 24/170; 24/191

[58] Field of Search ..... 24/170, 191, 193, 24/311

[56] References Cited

U.S. PATENT DOCUMENTS

| | | | |
|---|---|---|---|
| 1,338,535 | 4/1920 | Russ | 24/170 |
| 1,354,771 | 10/1920 | McCormack | 24/170 |
| 1,427,162 | 8/1922 | Mix | 24/191 |
| 2,020,371 | 11/1935 | Nagel | 24/191 |
| 3,852,855 | 12/1974 | Bengtsson | 24/170 |
| 3,979,800 | 9/1976 | Masuda | 24/191 |
| 5,205,021 | 4/1993 | Durand | 24/170 |

*Primary Examiner*—Victor N. Sakran

[57] ABSTRACT

A method of engaging a belt-clamping buckle to hold a waist-encircled belt in place about the user in which the buckle closes from a clearance position into clamping engagement with the belt in the same direction as the waist-encircling direction, so that the closing movement tightens, rather than loosens, the belt and contributes to other noteworthy benefits.

1 Claim, 1 Drawing Sheet

BUCKLE FACEPLATE BELT CLAMP

Buckles which frictionally clamp, rather than have a pin-like component projected through the body of the belt, are obviously the buckle of choice for highly decorated belts, since the frictional engagement causes nominal surface marring compared to spaced openings necessary for the projected-through pin.

The present invention relates generally to an improved friction-clamping type buckle, in which more particularly the improvements facilitate the application of the belt in encircling relation about the user's waist and which obviates inadvertent release of the belt, all as will be subsequently explained in greater detail.

EXAMPLES OF THE PRIOR ART

One category of frictionally-clamping buckles, as exemplified by the buckle of U.S. Pat. No. 1,338,535 issued to Russ on Apr. 27, 1920 avoids the marring of the decorated belt through use of a clamping component on the external side of a buckle faceplate which frictionally engages the belt, but a lengthwise pull or tension applied to the clamped belt can overcome the frictional resistance of the clamping engagement and cause a reverse pivotal traverse in the clamping component which would corresponding result in inadvertent release of the belt.

In the buckle of U.S. Pat. No. 2,020,371 issued to Nagel on Nov. 12, 1935 the shortcoming of Russ is somewhat obviated by the interposed positioning of the clamping component beneath the buckle faceplate and against the user's waist, but the fixed belt end is attached to the buckle faceplate and thus there is no lengthwise tension applied to the clamping component to supplement the more favorable clamping component interposed position.

In U.S. Pat. No. 1,354,771 issued to McCormack about the time of Russ on Oct. 5, 1920, and more particularly illustrated in prior art FIGS. 7–10, there is both an interposed positioning of the clamping component and lengthwise tension applied thereto to, in turn, obviate inadvertent release of the belt. However, there remains as significant shortcomings that the belt clamping loosens, rather than tightens the waist encircled belt, that the clamping component is inhibited in its pivotal traverse necessary to establish gripping engagement of the belt, and other undesirable features.

Broadly, it is an object of the present invention to overcome the foregoing and other shortcomings of the prior art.

More particularly, it is an object to facilitate the belt applying procedure using a friction-clamping buckle that is unlikely to inadvertently open after it is closed upon the belt in the securing of the belt in place, tightens the belt during the initial closing, and contributes to other noteworthy conditions which will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims. FIG. 1 is a plan view of the within inventive buckle;

Figure 1:
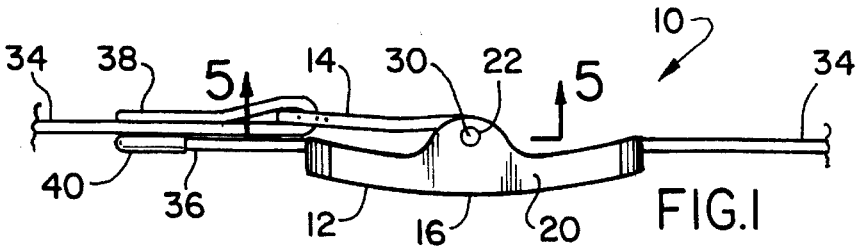
Figure 2:
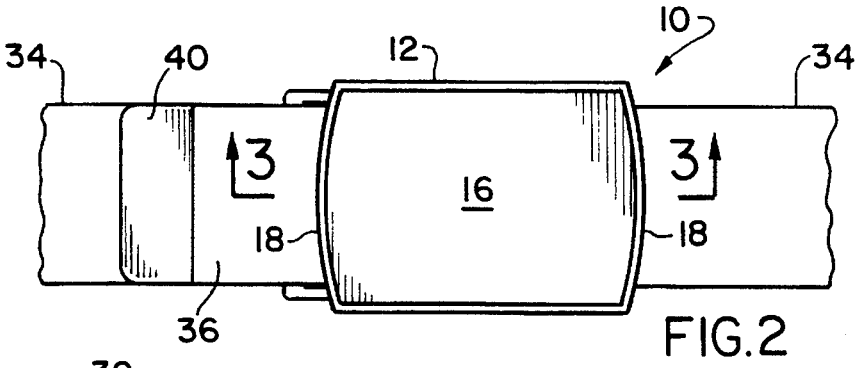
FIG. 2 is a front elevational view illustrating the buckle in its "closed" position.

The within inventive buckle, generally designated 10, is a simple construction consisting of a main body 12 and a belt clamp 14 both in a preferred embodiment being of plastic construction material.

Body member 12 is embodied with a curved faceplate 16 with a raised peripheral border 18 and side walls 20, which walls 20 at a midpoint have depending shapes which serve as pivot trunnions 22 between which clamp 14 is mounted in spanning relation so that there is relative pivotal movement between the body member or buckle 12 per se and the clamp 14. It is to be noted, however, that in use, as will be explained in sufficient detail subsequently, the clamp 14 is stationary and it is the buckle 12 which partakes of pivotal movement or traverses in relation to the clamp 14, such pivotal traverses occurring as a result of the opening and closing positions of the buckle 12. The opening of the buckle 12 serving the function of allowing the threading of the belt end through the clearance between the buckle 12 and clamp 14, and the closing of the buckle 12 actually resulting in the belt end being clamped against movement. As should be readily understood, the reverse movement sequence of the buckle 12 releases the belt end, i.e. the opening position unclamps the belt end allowing it to be unthreaded from the buckle.

Figure 5:
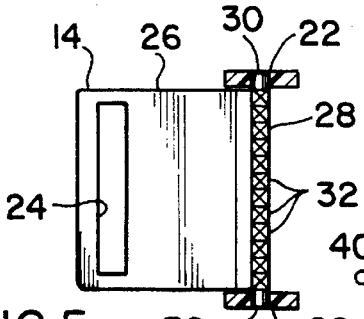
FIG. 5 is an isolated view of the belt attached portion of the buckle as seen along line 5—5 of FIG. 1.
Figure 3:
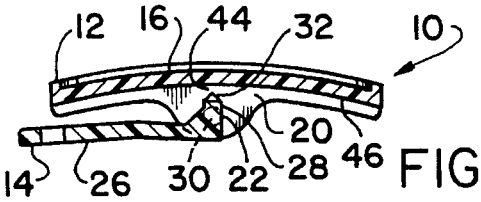
FIG. 3 is a cross sectional view taken along line 3—3 of FIG. 2, showing further details of the "closed" position of the buckle.
Figure 6:
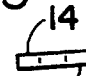
FIG. 6 is a bottom view projected from FIG. 5.

To serve the purposes noted, clamp 14, as best shown in FIGS. 5, 6 has a belt-attaching loop 24 adjacent an end of a long leg 26 and depending from an opposite end of leg 26 is a depending leg 28 journalled, as at 30, in the trunnions 22, but not for clamp movement, as much as for buckle 12 movement relative to clamp 14. Serrations or belt-engaging teeth structure 32 are provided along leg 28 in a clearance position beneath the buckle back surface 46 to define a passage 44 for threading a belt end through the buckle 12, clamp 14 combination structure.

As understood, buckle 10 is used with a belt 34, woven or otherwise constructed, having a free end 36 with a metal tip 40 and a fixed end 38 secured in an appropriate manner to the clamp 14, as at 24.

Figure 4:
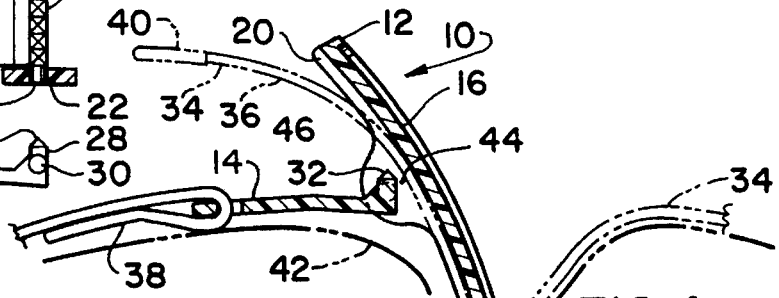
FIG. 4 is a view similar to FIG. 3 but showing the buckle in its "open" position incident to receiving a belt end in threaded relation therethrough preparatory to the belt end being clamped against movement by the "closed" position of the buckle.
Figure 7:
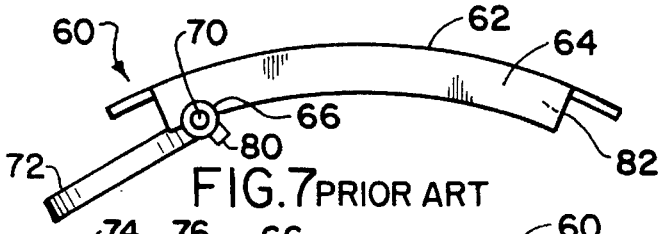
FIG.7 PRIOR ART
FIG. 7 is a plan view of a prior art buckle.
Figure 9:
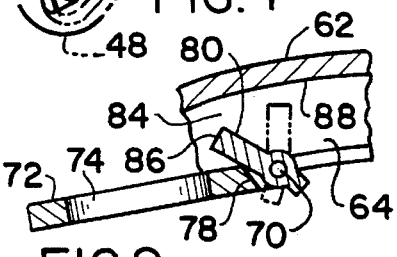
FIG.9 PRIOR ART
FIG. 9 is a partial cross sectional view taken along line 9—9 of FIG. 8.
Figure 8:
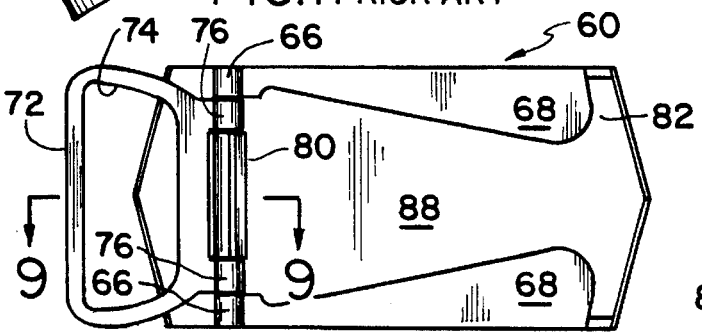
FIG.8 PRIOR ART
FIG. 8 is a rear view of the prior art buckle as projected from FIG. 7.
Figure 10:
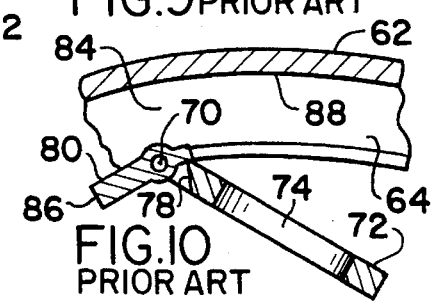
FIG.10 PRIOR ART
FIG. 10 is a view similar to FIG. 9, but showing the prior art buckle in its "open" condition.

The length of belt 34 is sized to the waist of a user 42, and placed in encircling relation about the user's waist, depicted in FIG. 4 by the reference line 42. As illustrated in FIG. 4, buckle 12 is urged through a clockwise pivotal traverse to open the clearance 44 for the threading therethrough of the belt end 36, and then drawn lengthwise to the extent of the length of belt 34 necessary to complete the encirclement of the belt 34 about the user's waist 42. Underlying the present invention is the recognition that the pivotal traverse noted, in this example being clockwise, is possible because the underlying stomach of the user is typically sufficiently pliable to allow this degree of movement. After this positioning of the belt 34, and with the clamp 14 flat against the waist 42 and stationary, the buckle 12 is urged through counterclockwise pivotal movement, and this clamps the belt 34, as at the serrations 32, against lengthwise movement. Additionally, the buckle pivotal movement is in the lengthwise directional threaded movement of belt 34 to contribute to tightening the belt 34 about the user's waist 42.

Moreover, both the clamp 14 and buckle overlying undersurface 46 in the closed position of the buckle construction 12, 14 are flat against the user's waist 42, thereby obviating inadvertent opening and consequent release of the belt 34.

The aforesaid use of the within inventive buckle 10 compares favorably with prior art use of this classification of buckles, as exemplified by the McCormack buckle 60 of U.S. Pat. No. 1,354,771 shown in FIGS. 7, 8, 9 and 10.

The buckle 60 of the prior art has a curved faceplate 62 with depending walls 64 embodying bearings 66 positioned within inturned flanges 68 extending from the walls 64. A through rod 70 is journalled in bearings 66.

A belt-attaching plate 72 having adjacent one end a loop 74 and adjacent an opposite end lugs 76 is journalled for pivotal movement adjacent the lug end upon the rod 70, the portion of the plate 72 between the lugs 76 being provided with a bevel 78.

An oblong clamping plate 80 is disposed between lugs 76 and configured to pivot about rod 70. Angular movement of plate 80 relative to belt plate 72 is limited to the angle illustrated in FIG. 9, i.e. the angle illustrated in solid and phantom perspective.

In use (FIG. 7) a belt (not shown) is connected to loop 74 in a conventional way. The free end of the belt is passed about the user and threaded through the space 82 left between the undersurface of faceplate 62 and flanges 68. The lead or free end of the belt is further guided through a space 84 left between the top edge 86 of plate 80 and the undersurface 88 of faceplate 62. When drawn to its proper tension, belt and buckle 60 are released and outward urgency of contact with the user's waist and/or manual manipulation causes clamp plate 80 to rotate clockwise (FIG. 9) about rod 70 and thus clamp the belt in the nip or reduced clearance 84.

In the prior art belt-applying procedure the clamp 72, rather than the buckle faceplate 62, is thus closed against the belt, this method step being dictated by the location of the pivot axis 70 at an end rather than at a midpoint of the assembled clamp 72 and buckle faceplate 62. Thus, when initially gripped and preparatory to completion of the gripping engagement to the belt, the pivotal traverse of the clamp 72 is opposite to the directional threading movement of the belt, and consequently loosens, rather than tightens the belt about the user's waist.

Even more of a shortcoming is due to the fixed end of the belt being connected, as at loop 74, to the clamp 72 which impedes the belt-clamping pivotal traverse of clamp 72. In contrast, the belt 34, as explained in connection with FIGS. 1–6 is fixed, as at 24, to a stationary clamp component 14 and, as such, does not impede or otherwise adversely affect the degree of pivotal traversing movement of the faceplate 16 of the within inventive buckle 10.

While the buckle for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed:

1. A method of fitting a belt in encircling relation about a user's waist with a buckle of a type having an external and underside surfaced faceplate and a pivotally traversable clamp having opposite proximal and distal ends, said method comprising the steps of fabricating said faceplate with spaced apart pivot trunnions at a medial location thereon and in depending relation to said underside surface, fabricating said clamp in a planar configuration at said proximal end and with a belt-engaging laterally extending projection at said distal end, mounting said clamp in spanning relation between said pivot trunnions to partake of pivotal movement beneath said faceplate underside surface, attaching a first of opposite ends of a belt to said clamp proximal end, positioning said clamp with said attached belt in an interposed condition with said planar proximal end flat on one side against said overlying faceplate and flat on an opposite side against said user's waist such that said contact with said user's waist holds said clamp stationary, extending from said clamp-attached belt a remaining belt length portion in encircling relation in a counterclockwise direction about said user's waist, urging in opening movement said faceplate from an adjacent-clamp position into a clearance position therefrom to form a nip between said faceplate underside surface and said beltengaging projection of said clamp, said nip having a size corresponding to the extent of pivotal movement permitted by the projection of an opposite portion of said faceplate into said user's waist, inserting an unattached said second belt end in said nip between said clamp belt-engaging projection and said faceplate underside surface, pulling in a counterclockwise direction said belt so as to form a closed loop thereof sized to preliminarily fit about said user's waist, and conjointly urging in closing movement said faceplate from said clearance position back to said adjacent-clamp position so as to simultaneously urge said belt in said nip in additive counterclockwise movement to thereby form a tighter closed loop about said user's waist, whereby said belt is held against clockwise movement in said nip between said stationary clamp and said overlying faceplate closed upon said belt.

* * * * *